US009413087B2

(12) United States Patent
Shariff et al.

(10) Patent No.: US 9,413,087 B2
(45) Date of Patent: Aug. 9, 2016

(54) DATA AND POWER CONNECTOR

(71) Applicant: MICROSOFT TECHNOLOGY LICENSING, LLC, Redmond, WA (US)

(72) Inventors: Farah Shariff, Kirkland, WA (US); Vinod L. Hingorani, Sammamish, WA (US); Stephen John Minarsch, Seattle, WA (US); Scott Dallmeyer, Seattle, WA (US); Thomas E. McCue, Jr., Vancouver, WA (US)

(73) Assignee: MICROSOFT TECHNOLOGY LICENSING, LLC, Redmond, WA (US)

( * ) Notice: Subject to any disclaimer, the term of this patent is extended or adjusted under 35 U.S.C. 154(b) by 36 days.

(21) Appl. No.: 14/292,456

(22) Filed: May 30, 2014

(65) Prior Publication Data

US 2015/0349457 A1 Dec. 3, 2015

(51) Int. Cl.

| | |
|---|---|
| ***H01R 11/00*** | (2006.01) |
| ***H01R 11/30*** | (2006.01) |
| ***H01R 24/20*** | (2011.01) |
| ***H01R 13/62*** | (2006.01) |

(52) U.S. Cl.

CPC ..... *H01R 11/30* (2013.01); *H01R 13/6205* (2013.01); *H01R 24/20* (2013.01)

(58) Field of Classification Search

CPC .... H01R 13/24; H01R 13/6205; H01R 31/02; H01R 31/06; H01R 11/00; H01R 11/30; A41D 1/002; A41D 1/005

USPC ..... 439/502, 37–40

See application file for complete search history.

(56) References Cited

U.S. PATENT DOCUMENTS

| | | | | |
|---|---|---|---|---|
| 3,649,742 | A * | 3/1972 | Tissot | H01P 5/00 174/115 |
| 6,944,701 | B2 | 9/2005 | Yu et al. | |
| 7,094,086 | B2 | 8/2006 | Teicher | |
| 7,310,697 | B2 | 12/2007 | Pandit et al. | |
| 7,435,094 | B2 * | 10/2008 | Chang | H01M 10/48 320/107 |
| 7,679,317 | B2 | 3/2010 | Veselic | |
| 8,143,983 | B1 * | 3/2012 | Lauder | G06F 1/1626 24/303 |
| 8,478,912 | B2 | 7/2013 | Liu et al. | |

(Continued)

FOREIGN PATENT DOCUMENTS

| | | |
|---|---|---|
| EP | 2590274 A2 | 5/2013 |
| EP | 2722936 A1 | 4/2014 |

(Continued)

OTHER PUBLICATIONS

Hughes, Neil., "Apple's Lightning Port Dynamically Assigns Pins to Allow for Reversible Use", Published on: Sep. 25, 2012 Available at: http://appleinsider.com/articles/12/09/25/apples_lightning_port_dynamically_assigns_pins_to_allow_for_reversible_use.

(Continued)

*Primary Examiner* — Hien Vu

(74) *Attorney, Agent, or Firm* — Brandon Roper; Judy Yee; Micky Minhas

(57) ABSTRACT

Embodiments are disclosed for a power and data connector comprising a magnet, a film adhered to a surface of the magnet, and a stage extending away from the film. The power and data connector further comprises a plurality of electrical contacts disposed on the stage, the plurality of electrical contacts having a mirrored signal pin-out.

20 Claims, 9 Drawing Sheets

(56) References Cited

U.S. PATENT DOCUMENTS

| | | | | |
|---|---|---|---|---|
| 8,517,766 | B2 | 8/2013 | Golko et al. | |
| 8,612,002 | B2 | 12/2013 | Faltys et al. | |
| 2011/0092081 | A1* | 4/2011 | Gao | H01R 9/03 439/40 |
| 2011/0098583 | A1 | 4/2011 | Pandia et al. | |
| 2012/0043937 | A1 | 2/2012 | Williams | |
| 2013/0007336 | A1 | 1/2013 | Chun et al. | |
| 2013/0103966 | A1 | 4/2013 | Liu | |
| 2013/0244494 | A1 | 9/2013 | Tziviskos et al. | |
| 2013/0304942 | A1 | 11/2013 | Golembeski et al. | |
| 2014/0015470 | A1 | 1/2014 | Lim et al. | |
| 2014/0121539 | A1 | 5/2014 | Chatterjee et al. | |

FOREIGN PATENT DOCUMENTS

| | | | |
|---|---|---|---|
| KR | 101078214 | B1 | 11/2011 |
| WO | 2009082751 | A2 | 7/2009 |
| WO | 2013157788 | A1 | 10/2013 |

OTHER PUBLICATIONS

"Dual USB Bracket-15" Dual USB female connectors on Rear Bulkhead Bracket to dual 5-pin header connectors, USB Cable is Super Long—15 inches", Published on: May 28, 2013 Available at: http://www.ramelectronics.net/product.aspx?zpid=1040.

Fingas, Jon, "TomTom's new GPS watches track your heart rate without a chest strap (update: US pricing)", http://www.engadget.com/2014/04/03/tomtom-cardio-gps-watches/, Apr. 3, 2014, 10 pages.

Goode, Lauren, "Samsung's New Gear Fit Needs to Work on the "Fit" Part", http://recode.net/2014/04/08/samsungs-new-gear-fit-needs-to-work-on-the-fit-part/, Apr. 8, 2014, 10 pages.

"Samsung Gear Fit, Gear 2 and Gear 2 Neo go on sale worldwide", NDTV Gadgets, http://gadgets.ndtv.com/others/news/samsung-gear-fit-gear-2-and-gear-2-neo-go-on-sale-worldwide-507220, Apr. 11, 2014, 3 pages.

Poeter, Damon, "Meet Simband, Samsung's Next-Gen Health Tracker", http://www.pcmag.com/article2/0,2817,2458663,00.asp, May 28, 2014, 5 pages.

ISA European Patent Office, International Search Report and Written Opinion Issued in Application No. PCT/US2015/032506, Aug. 21, 2015, WIPO, 11 pages.

"Universal Gadget Wrist Charger", ThinkGeek, Inc., Published on: Jul. 11, 2012, Available at: http://www.thinkgeek.com/product/ceca/, 3 pages.

"Wearable Solar-Powered Leaf Phone Charges on the Go", Inhabitat, Retrieved on: Apr. 15, 2014 Available at: http://inhabitat.com/wearable-solar-powered-leaf-phone-charges-on-the-go/leafsolarphonebracelet-5/, 7 pages.

"iWatch—Apple First Wearable Device will Wireless Charging Enabled", Wireless Efficiency, Published on: Dec. 16, 2013, Available at: http://www.wirelessefficiency.com/?p=2755, 3 pages.

Grush, Andrew, "Carbon is a Wearable Solar Charger that Doubles as an Analog Watch", Published on: Mar. 10, 2014, Available at: http://www.androidauthority.com/carbon-solar-charger-355768/, 9 pages.

Andronico, Michael, "Your Next Wearable Might Be Charged by Body Heat", Published on: Apr. 14, 2014, Available at: http://blog.laptopmag.com/wearables-body-heat, 3 pages.

"Introducing SquareWear 2.0—An Open-Source Wearable Arduino", RaysHobby.net, Published on: Nov. 22, 2013, Available at: http://rayshobby.net/?p=7964, 4 pages.

Dawson, Tom, "Wired and Wireless Charging Docks Appear on ASUS' Website for the Nexus 7 (2013)", Published on: Jan. 20, 2014, Available at: http://www.androidheadlines.com/2014/01/wired-wireless-charging-docks-appear-asus-website-nexus-7-2013.html, 7 pages.

"TsirTech Universal Wrist Band Gadget Charger With Built-In Battery for Ipod Touch, IPad, IPad 2, IPhone4/4SMP3/MP4, PSP, NDS, Samsung, Nokia, LG, HTC (Black)", Amazon, Published on: Nov. 29, 2012, Available at: http://www.amazon.com/TsirTech-Universal-Charger-Built-In-Battery/dp/B0088P5BR6, 5 pages.

* cited by examiner

DATA AND POWER CONNECTOR

BACKGROUND

Portable devices are often powered by rechargeable batteries. While some portable devices include rechargeable batteries that may be removed and charged externally to the device, other portable devices include a port to accept a power connector of a recharging cable and/or device. The port may also be configured to accept data signals from the recharging cable and/or device. For example, the recharging cable and/or device may also connect to a computing device and transmit data between the portable device and the computing device.

DETAILED DESCRIPTION

Power and data connectors may couple to an associated port in a number of ways. For example, snap-fit or other mechanical arrangements may be used to provide a structural connection that resists disconnection and allows tactile feedback to confirm a secure connection. However, some purely snap-fit arrangements may require structure and mechanisms that are unsightly, overly complex, high maintenance (e.g., difficult to keep free of debris), and/or uncomfortable to a user when disposed on portable devices such as wearable devices. Magnetic arrangements may help guide a power and data connector toward an associated port to assist with alignment of the connector without the need for precise visually-aided guidance.

According to one embodiment, a power and data connector includes a magnet, a film adhered to a surface of the magnet, and a stage extending away from the film. The power and data connector further comprises a plurality of electrical contacts disposed on the stage, the plurality of electrical contacts having a mirrored signal pin-out.

A power and data connector may utilize a magnetically attractive surface and a protruding stage configured to fit into a corresponding well of a power and data port. In this way, the power and data connector may mitigate the aesthetic and operational deficiencies of some mechanical arrangements while still providing tactile feedback of a successful connection. For example, the amount of protrusion of the stage (and consequently the amount of depression of an associated well of a power and data port) may be reduced relative to a purely mechanical arrangement, as the magnetically attractive surface may assist in providing a secure coupling. The magnetically attractive surface (e.g., a magnetically attractive surface of the magnetically attractive elements) may be unhoused, so as to lessen a connected distance between the surface and a corresponding surface of the port. The power and data connector may also include a mirrored pin-out, enabling orientation-agnostic mating of the connector to the associated port. While described below in the context of a portable wearable electronic device, the examples of the power and data connector of this disclosure may be implemented with different types of sensor and logic systems.

Figure 1A:
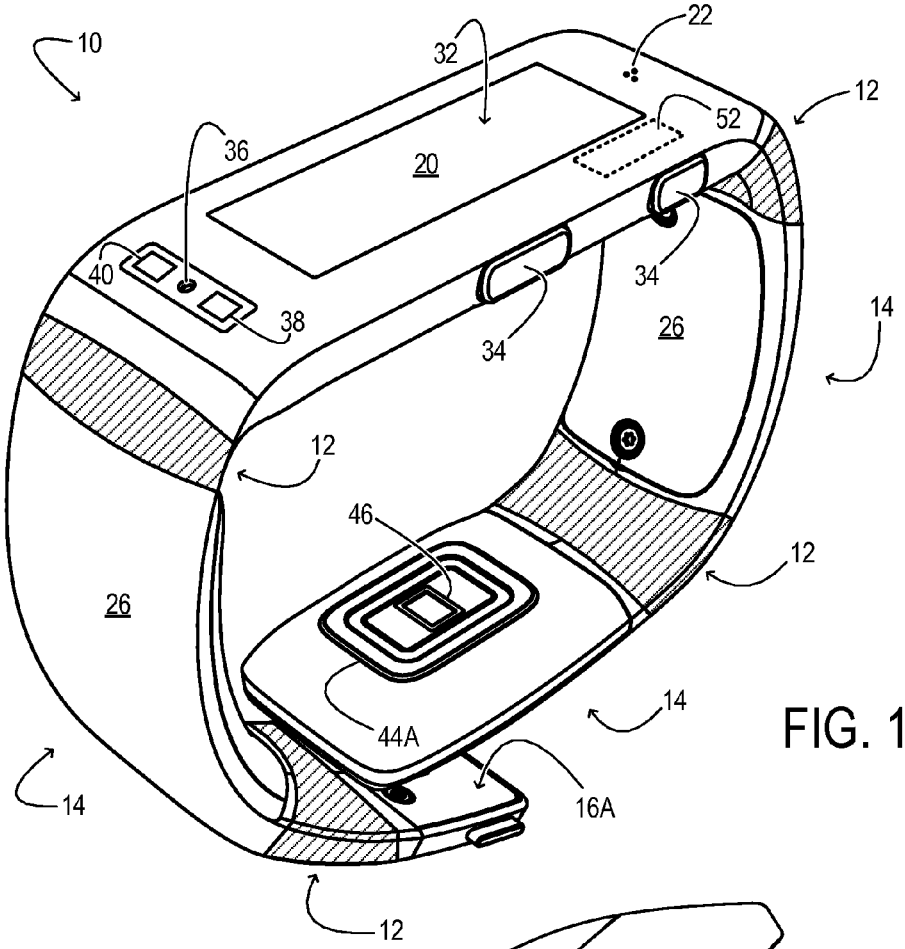
FIGS. 1A and 1B show an exemplary wearable electronic device.
Figure 1B:
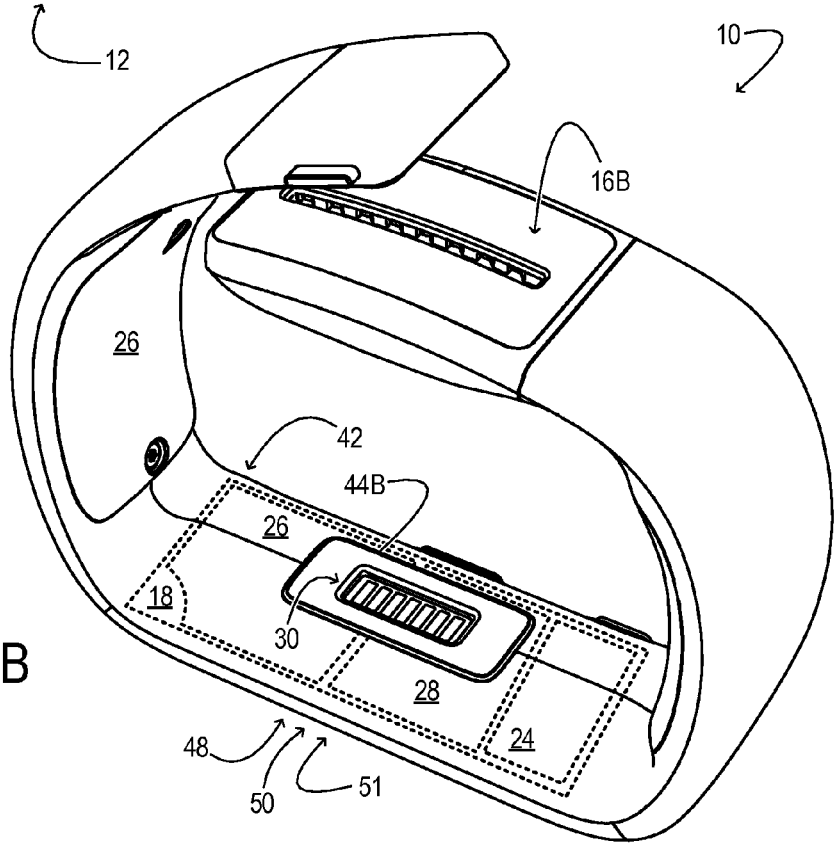

FIGS. 1A and 1B show aspects of an example sensory-and-logic system in the form of a wearable electronic device 10. The illustrated device is band-shaped and may be worn around a wrist. Device 10 includes at least four flexion regions 12 linking less flexible regions 14. The flexion regions of device 10 may be elastomeric in some examples. Fastening componentry 16A and 16B is arranged at both ends of the device. The flexion regions and fastening componentry enable the device to be closed into a loop and to be worn on a user's wrist. In other implementations, wearable electronic devices of a more elongate band shape may be worn around the user's bicep, waist, chest, ankle, leg, head, or other body part. The device, for example, may take the form of eye glasses, a head band, an arm-band, an ankle band, a chest strap, or an implantable device to be implanted in tissue.

Wearable electronic device 10 includes various functional components integrated into regions 14. In particular, the electronic device includes a compute system 18, display 20, loudspeaker 22, communication suite 24, and various sensors. These components draw power from one or more energy-storage cells 26. A battery—e.g., a lithium ion battery—is one type of energy-storage cell suitable for this purpose. Examples of alternative energy-storage cells include super- and ultra-capacitors. In devices worn on the user's wrist, the energy-storage cells may be curved to fit the wrist, as shown in the drawings.

In general, energy-storage cells 26 may be replaceable and/or rechargeable. In some examples, recharge power may be provided through a power and data port, such as universal serial bus (USB) port 30, which includes a magnetic latch to releasably secure a complementary USB connector. In other examples, the energy storage cells may be recharged by wireless inductive or ambient-light charging. In still other examples, the wearable electronic device may include electro-mechanical componentry to recharge the energy storage cells from the user's adventitious or purposeful body motion. For example, batteries or capacitors may be charged via an electromechanical generator integrated into device 10. The generator may be turned by a mechanical armature that turns while the user is moving and wearing device 10.

In wearable electronic device 10, compute system 18 is situated below display 20 and operatively coupled to the display, along with loudspeaker 22, communication suite 24, and the various sensors. The compute system includes a data-storage machine 27 to hold data and instructions, and a logic machine 28 to execute the instructions. Aspects of the compute system are described in further detail with reference to FIG. 9.

Display 20 may be any suitable type of display. In some configurations, a thin, low-power light emitting diode (LED) array or a liquid-crystal display (LCD) array may be used. An LCD array may be backlit in some implementations. In other implementations, a reflective LCD array (e.g., a liquid crystal on silicon, LCOS array) may be frontlit via ambient light. A curved display may also be used. Further, AMOLED displays or quantum dot displays may be used.

Communication suite 24 may include any appropriate wired or wireless communications componentry. In FIGS. 1A and 1B, the communications suite includes USB port 30, which may be used for exchanging data between wearable electronic device 10 and other computer systems, as well as providing recharge power. The communication suite may further include two-way Bluetooth, Wi-Fi, cellular, near-field communication and/or other radios. In some implementations, the communication suite may include an additional transceiver for optical, line-of-sight (e.g., infrared) communication.

In wearable electronic device 10, touch-screen sensor 32 is coupled to display 20 and configured to receive touch input from the user. The touch sensor may be resistive, capacitive, or optically based. Pushbutton sensors may be used to detect the state of push buttons 34, which may include rockers. Input from the pushbutton sensors may be used to enact a home-key or on-off feature, control audio volume, turn the microphone on or off, etc.

FIGS. 1A and 1B show various other sensors of wearable electronic device 10. Such sensors include microphone 36, visible-light sensor 38, ultraviolet sensor 40, and ambient temperature sensor 42. The microphone provides input to compute system 18 that may be used to measure the ambient sound level or receive voice commands from the wearer. Input from the visible-light sensor, ultraviolet sensor, and ambient temperature sensor may be used to assess aspects of the wearer's environment—e.g., the temperature, overall lighting level, whether the wearer is indoors or outdoors, etc.

FIGS. 1A and 1B show a pair of contact sensor modules 44A and 44B, which contact the wearer's skin when wearable electronic device 10 is worn. The contact sensor modules may include independent or cooperating sensor elements, to provide a plurality of sensory functions. For example, the contact sensor modules may provide an electrical resistance and/or capacitance sensory function, which measures the electrical resistance and/or capacitance of the wearer's skin. Compute system 18 may use such input to assess whether or not the device is being worn, for instance. In some implementations, the sensory function may be used to determine how tightly the wearable electronic device is being worn. In the illustrated configuration, the separation between the two contact-sensor modules provides a relatively long electrical path length, for more accurate measurement of skin resistance. In some examples, a contact sensor module may also provide measurement of the wearer's skin temperature. Arranged inside contact sensor module 44B in the illustrated configuration is an optical pulse rate sensor 46. The optical pulse-rate sensor may include an LED emitter and matched photodiode to detect blood flow through the capillaries in the skin and thereby provide a measurement of the wearer's pulse rate.

Wearable electronic device 10 may also include motion sensing componentry, such as an accelerometer 48, gyroscope 50, and magnetometer 51. The accelerometer and gyroscope may furnish inertial and/or rotation rate data along three orthogonal axes as well as rotational data about the three axes, for a combined six degrees of freedom. This sensory data can be used to provide a pedometer/calorie-counting function, for example. Data from the accelerometer and gyroscope may be combined with geomagnetic data from the magnetometer to further define the inertial and rotational data in terms of geographic orientation. The wearable electronic device may also include a global positioning system (GPS) receiver 52 for determining the wearer's geographic location and/or velocity. In some configurations, the antenna of the GPS receiver may be relatively flexible and extend into flexion regions 12.

Compute system 18, via the sensory functions described herein, is configured to acquire various forms of information about the wearer of wearable electronic device 10. When such information is acquired, the information is acquired and used with utmost respect for the wearer's privacy. Accordingly, the sensory functions may be enacted subject to opt-in participation of the wearer. In implementations where personal data is collected on the device and transmitted to a remote system for processing, that data may be anonymized. In other examples, personal data may be confined to the wearable electronic device, and only non-personal, summary data transmitted to the remote system.

Figure 2:
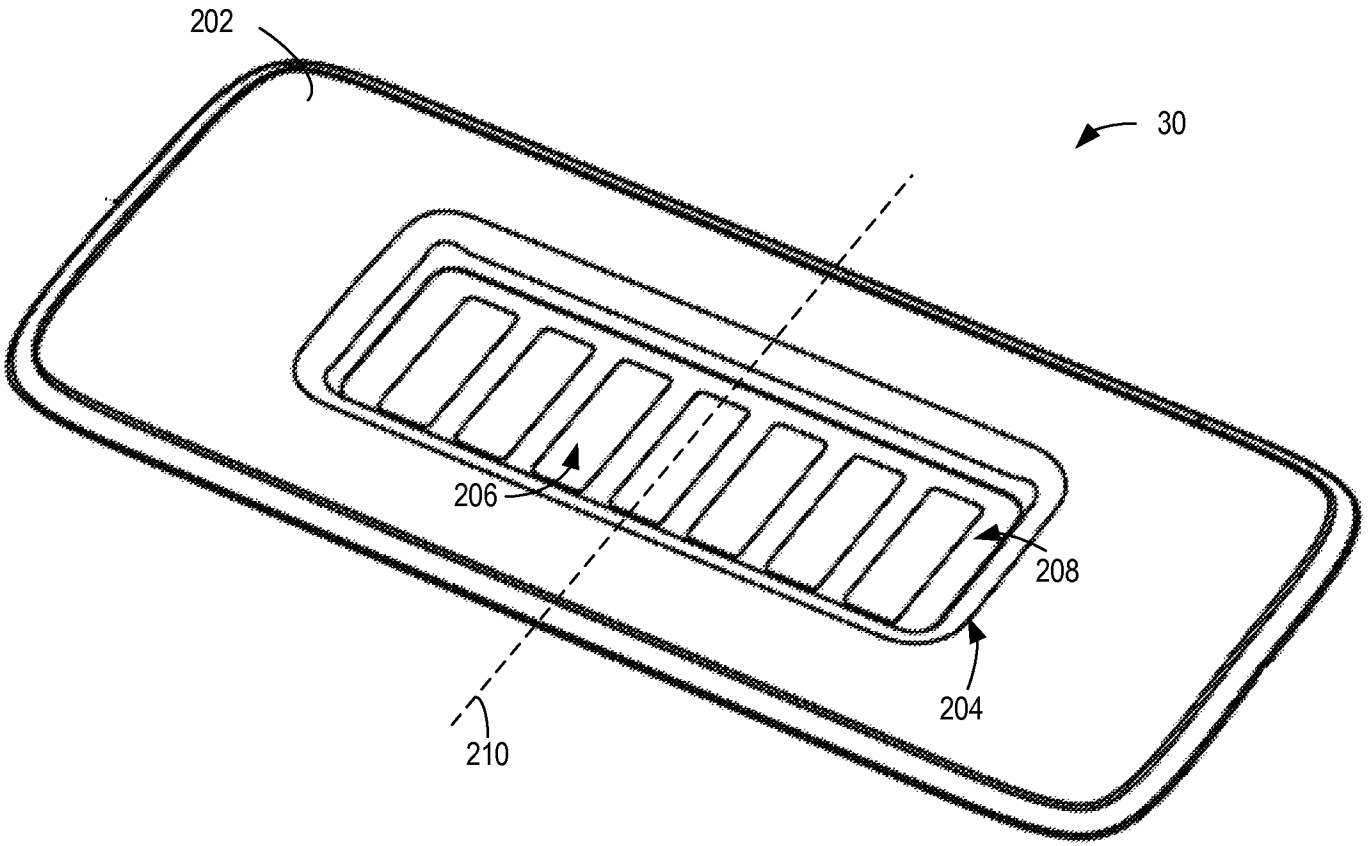
FIG. 2 shows the example power and data port of the wearable electronic device of FIG. 1B.

FIG. 2 shows a detailed view of USB port 30 of FIG. 1B. USB port 30 may include a metal frame 202 surrounding a well 204. Metal frame 202 may be constructed from any suitable metal or metal alloy, such as aluminum in one example. The outward surface of the metal frame may be finished (e.g., with a satin finish) in order to provide a smooth surface that is comfortable to the skin of a wearer. In some examples, the outward surface may include a plurality of protrusions and/or a rough finish in order to ensure contact with a wearer's skin and/or to facilitate a connection with a power and data connector. As illustrated, metal frame 202 may be substantially rectangular in shape with rounded corners. In some examples, metal frame 202 may be included in a sensing system, such as a galvanic skin response sensor. In such examples, metal frame 202 may be configured to form an electrical and/or physical connection with human skin. One or more magnets may be housed underneath and/or within metal frame 202 in order to provide a magnetically attractive surface in some examples. In additional or alternative examples, metal frame 202 may be formed of a material (e.g., a metal or metal alloy) that is attractable to magnets.

A plurality of charging contact pads 206 may be disposed within the well 204 for connecting to associated electrical contacts of a power and data connector, described in more detail below with respect to FIGS. 3-7. Charging contact pads 206 may be formed of an electrically conductive material, such as gold, and disposed on a frame 208 formed from non-electrically conductive material, such as plastic. The non-electrically conductive material may be utilized to isolate the electrical signaling provided to and from each of the charging contact pads 206. Charging contact pads 206 may be electrically connected to one or more compute systems within the wearable electronic device 10. For example, a contact pad configured to receive a power signal may be electrically connected to a battery and/or recharging system. A contact pad configured to receive a data signal may be electrically connected to a logic system and/or data-storage system of the wearable electronic device 10.

In the illustrated example, seven charging contact pads are shown. The contact pads may have a mirrored pin-out structure. For example, a leftmost end and rightmost end charging contact pad may be defined as electrical ground. Moving inward from both ends, a next pair of charging contact pads may be configured to receive a positive data signal. Moving further inward, a next pair of charging contact pads may be configured to receive a negative or inverted data signal. A central charging contact pad may be configured to receive a power signal (e.g., from a voltage source of a charging device) to recharge the batteries of the wearable electronic device 10. Pairs of contact pads configured to receive the same type of signal may be electrically tied together. In this way, the contact pads 206 may be symmetrically aligned with an axis of symmetry that is coaxial to a central axis 210 bisecting just the central contact pad. Metal frame 202 may be configured to be electrical ground, and may be connected to the leftmost end and rightmost end of the charging contact pads.

Although seven charging contact pads are illustrated in FIG. 2, it is to be understood that the USB port 30 may include any suitable number of charging contact pads. For example, five charging contact pads may be utilized, where a leftmost end and rightmost end contact pad is configured to receive a positive data signal. In such an example, a next pair of charging contact pads moving inward from the leftmost and rightmost ends may be configured to receive a negative or inverted data signal. A center contact pad may be configured to receive a power signal, while a metal ring around the contact pads may be configured to provide a grounded contact. Although described herein as having a USB pin-out, it is to be understood that port 30 may include any suitable arrangement of contact pads and associated electrical connections for communicating using any compatible protocol.

Inwardly protruding walls of well 204 may angle inward such that the length and/or width (e.g., the area) of well 204 is smaller at the charger contact pad frame 208 than the length and/or width of well 204 at the outer surface of the metal frame 202. The tapering of the well 204 may assist with the guidance and connectivity of an associated power and data connector as it is inserted into the well 204.

Figure 3:
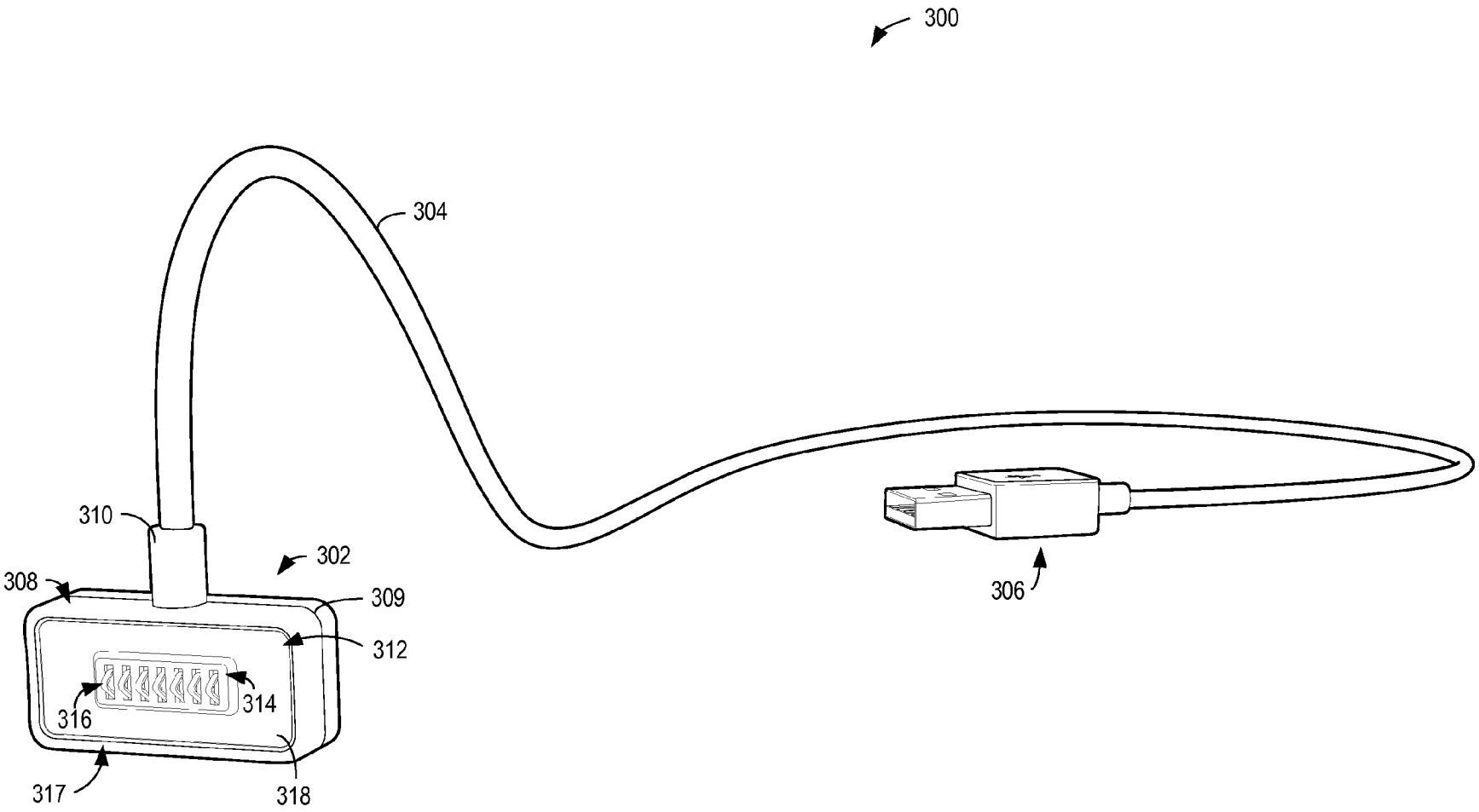
FIG. 3 shows an exemplary power and data connector.

As described above, the USB port 30 may be configured to connect to a power and data connector in order to recharge batteries of the wearable electronic device and/or transmit/receive data from another computing device. FIG. 3 shows an example power and data connector 300 for connecting to a power and data port, such as USB port 30 of FIGS. 1B and 2. Power and data connector 300 includes a connector head 302 on one end of a power and data cable 304 and terminates in a power and data plug (e.g., a USB plug 306) on an opposite end of power and data cable 304. For example, USB plug 306 may be configured to couple with a USB port on a computing device, wall-mounted recharger, and/or other recharging device. It is to be understood that other examples may include additional or alternative power and data plugs (e.g., Ethernet, FireWire, eSATA, Thunderbolt, etc.) and/or other types of USB plugs than illustrated (e.g., mini-B USB plugs, micro-A/B USB plugs, etc.). Connector head 302 and associated electrical components may be a male connector configured to couple with a female port (e.g., USB port) on a portable computing device, such as wearable electronic device 10 of FIGS. 1A and 1B. Power and data cable 304 may be any suitable size/shape of cabling and may include a plurality of wires bundled together (e.g., including a twisted pair configuration) and/or electrically isolated from one another. The bundle of wires in the power and data cable may be encased in an electrically non-conductive material.

Connector head 302 may form a body of the power and data connector and include a top surface 308 of a connector housing, from which power and data cable 304 extends. For example, a strain relief 310 may be centered on top surface 308 and/or placed in a location to ensure a balance of weight distribution on different sides of the power and data cable. The connector head 302 and/or connector housing may be bisected by seam 309, and strain relief may be centered along the seam. Strain relief 310 may also restrict and/or bias power and data cable 304 to extend in a substantially straight line perpendicular to top surface 308 for a particular length of the cable. In some examples, strain relief 310 may cause the power and data cable to be less flexible in a region near connector head 302 than other regions of the cable (e.g., a center region between connector head 302 and USB plug 306). Increased rigidity in this end region may allow power and data cable 304 to substantially support the weight of connector head 302. This rigidity may allow a user to guide the connector head to a location without directly holding or touching the connector head (e.g., when a user's fingers/hand may obscure a connection location if placed on or near the connector head). The strain relief may also protect the cabling from wear and tear at a junction between the power and data cable 304 and the connector head 302.

A front surface 312 of connector head 302 may be adjacent to the top surface 308. For example, seam 309 may bisect connector head 302 into a front and back portion (e.g., bisecting the top, bottom, and side surfaces of the connector head and/or connector housing). Front surface 312 may be a front/outer surface of the front portion of the connector head. Front surface 312 may be a magnetically attractive surface and may include a stage 314 protruding from a central, depressed region of the surface. The stage 314 may protrude from a front surface of the connector housing and/or from an internal component of the connector head 302. A plurality of electrical contacts 316 may protrude through openings in the stage 314 and may be configured to interface with associated charging contact pads of a computing device, such as charging contact pads 206 of wearable electronic device 10 as illustrated in FIG. 2. A peripheral region 317 of front surface 312 may include a portion of the connector head and/or connector housing that protrudes relative to a central region of the front surface 312. For example, the connector housing of the power and data connector may include an overlapping edge that is in a parallel plane to the magnetically attractable surface and extends around a periphery of the magnetically attractable surface.

The central region of the front surface 312 may include a film 318 adhered to one or more magnetically attractable elements disposed in the connector head 302 and/or connector housing in some examples. The one or more magnetically attractable elements disposed in the connector head may include a permanent magnet, an electromagnet, and/or a material element that is attractable by a magnet in some examples. The film 318 may additionally or alternatively be adhered to a portion of the front surface 312 of the connector housing that is depressed relative to the peripheral region 317. Covering the magnet(s) with a film, rather than the thicker plastic material of the connector housing, allows the magnet(s) to be as close as possible to a magnetically attractable element while still preventing direct exposure of the magnet. The film may be a thin, flexible material, such as Mylar.

Figure 4B:
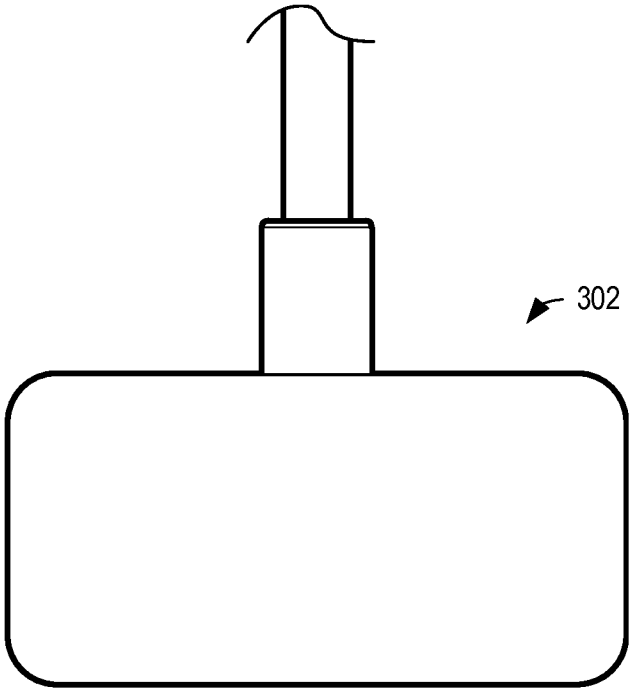
FIGS. 4A-4D show an exemplary power and data connector head.
Figure 4A:
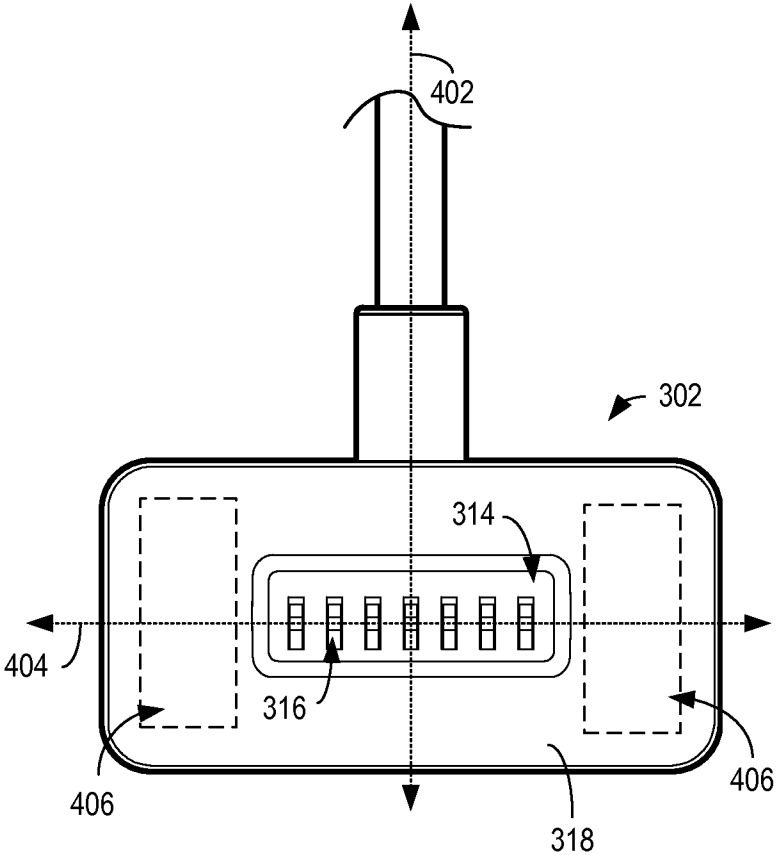
Figure 4D:
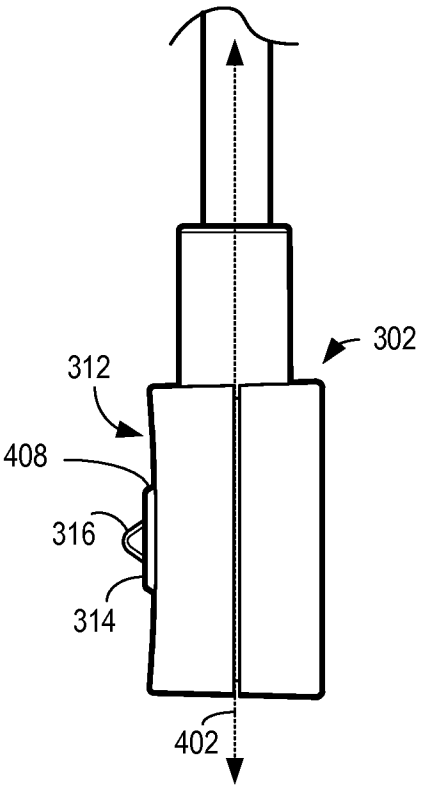
Figure 4C:
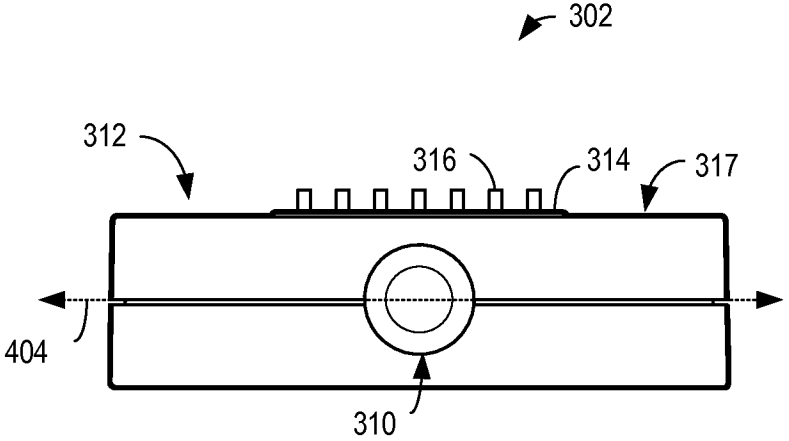

FIGS. 4A-4C show several views of the connector head 302 of FIG. 3. In particular, FIG. 4A shows a front view of the connector head 302. As illustrated, the electrical connectors may have mirrored-physical and -electrical symmetry to one another, a vertical axis 402 being the axis of symmetry. Vertical axis 402 bisects only a center electrical connector and is perpendicular to longitudinal axis 404, which bisects all of the electrical connectors and/or a front surface of the connector head 302 along a widest dimension of the stage 314 and/or the front surface of the connector head 302. Magnets 406 may be disposed in the connector head 302 under film 318, creating a magnetic front surface of the connector head. Magnets 406 may be symmetric to one another, and the vertical and/or longitudinal axes 402 and 404 may be the axis of symmetry of the magnets 406. Each of the magnets may be positioned to protrude through and/or be flush with a respective opening in an outer surface of a front portion of the connector housing. In some embodiments, film 318 may contact only magnets 406 and the connector housing may not extend within the central, depressed region of the front surface 312 of the connector head 302.

In some examples, film 318 may be a ring-shaped, generally rectangular flexible adhesive material adapted to contact the metal frame 202 of the USB port 30 illustrated in FIG. 2. The geometric area of the film may be at least 2.5 times larger than the geometric area of the stage 314 in order to provide coverage for a large area of magnetic element surfaces (e.g., to provide a large magnetic force) and/or to enable the film to contact all or most of the metal frame 202. Film 318 may be disposed on, in face-sharing contact with, and/or adhered to a depressed region of an outer surface of a front portion of the connector head and/or the connector housing. Film 318 may further be disposed on, in face-sharing contact with, and/or adhered to magnets 406 in order to provide a thinner buffer between the magnets and a magnetically attractable surface (e.g., the metal frame 202 of the USB port 30) than the connector housing of the connector head 302 may provide. The magnetic force provided by the magnets may be increased by decreasing a thickness of the buffer.

FIG. 4B shows a rear view of the connector head 302 including a back portion of the connector housing of the connector head. The view in FIG. 4B depicts the overall shape of the connector head 302 and/or connector housing, namely a generally rectangular shape with rounded corners in the illustrated example. It is to be understood that the connector head 302 may have any suitable shape in other examples. For example, the connector head 302 may be generally oval, generally polygonal, and/or any suitable shape with any number of straight and/or curved segments. The connector housing may form all or some of the outer surfaces of the connector head 302, and thus the connector housing may follow a shape of the connector head 302.

FIG. 4C shows a top view of the connector head 302. The view in FIG. 4C depicts the protrusion of the stage 314 and electrical contacts 316 relative to one another and relative to the peripheral region 317 of the front surface 312 of the connector head 302. For example, as shown, the stage 314 protrudes relative to the peripheral region 317 by an amount that is smaller than the amount of protrusion of the electrical contacts 316 relative to the stage 314. FIG. 4C also shows that the peripheral region 317 of the front surface 312, the stage 314, and the film 318 (contacting the depressed region of the front surface 312) are all substantially planar in a horizontal dimension that is parallel to the longitudinal axis 404.

FIG. 4D shows a side view of the connector head 302. The view in FIG. 4D depicts the shape of the protrusion of the electrical contacts 316, the shape of the protrusion of the stage 314, and the curvature of the connector head 302 and/or the connector housing (e.g., the front surface 312) and film 318 (e.g., contacting the depressed region of the front surface 312). As illustrated, the electrical contacts 316 include a triangular peak protruding from the stage 314. As described in more detail with respect to FIGS. 6 and 7, the electrical contacts 316 may be configured to be spring-loaded such that the contacts are biased to protrude from the stage 314, and may be depressed toward the connector head 302 (e.g., into the stage 314) responsive to force applied to the triangular peak. An outer surface of the stage 314 (e.g., the surface of the stage that is closest to the peak of the electrical contacts 316) may be planar in a dimension parallel to the vertical axis 402. Walls 408 of the stage 314 extending toward the connector head may be angled outward such that a base of the stage (e.g., a region of the stage closer to the connector head than the outer surface of the stage) has a larger geometric area (e.g., is longer and/or wider) than the outer surface of the stage. The front surface 312 of the connector head and the film 318 contacting the depressed region of the front surface 312 may curve concavely in the dimension parallel to the vertical axis 402 as illustrated. As the metal frame of the USB port 30 of the wearable electronic device may be slightly curved in a similar dimension in order to follow a curvature of a user's wrist, the connector head and film may be curved to enable a secure connection to the USB port.

Figure 5:
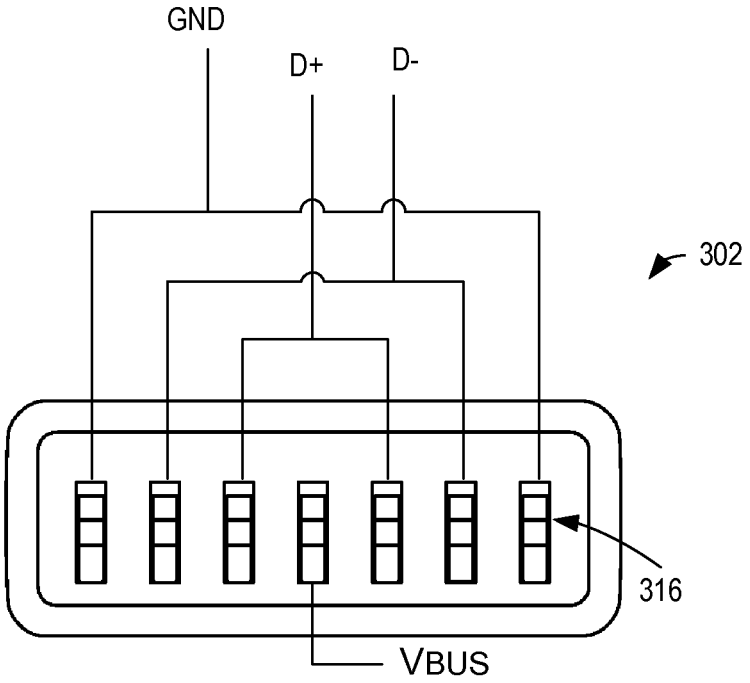
FIG. 5 shows an example schematic of electrical connections of an example power and data connector.

FIG. 5 schematically depicts electrical connections of the connector head 302. Wires from the power and data cable 304 may include a ground wire (GND), a positive data signal wire (D+), a negative data signal wire (D−), and a voltage signal wire (Vbus). Each signal wire may be electrically connected to an associated contact pad on a substrate (e.g., a printed circuit board) in the connector head 302 (e.g., within a housing of the connector head). Each electrical contact 316 may be electrically connected to an associated contact pad on an opposite side of the substrate from the wires and thereby electrically connected to one of a ground wire, a data signal wire, and a voltage signal wire. As the electrical contacts 316 may be mirror symmetric, a pair of electrical contacts symmetrically disposed with respect to the vertical axis may be electrically connected to the same contact pad and associated signal wire. For example, a pair of outermost electrical contacts may each be connected to the ground contact pad/signal wire, as illustrated. Likewise, another pair of electrical contacts may each be connected to the positive data contact pad/signal wire, as illustrated.

Figure 6:
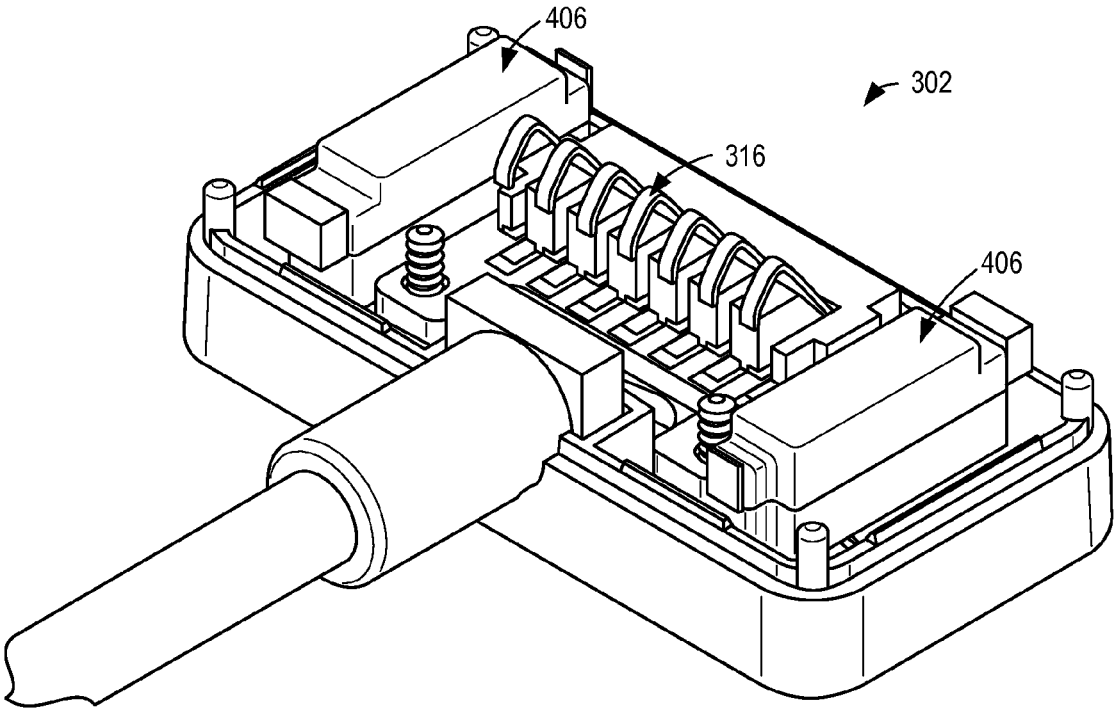
FIG. 6 shows an interior front view of an example power and data connector.

FIG. 6 shows an interior view of a front of the connector head 302 (e.g., within a connector housing of the connector head). For example, FIG. 6 illustrates an interior view of the front of the connector head 302 with a front connector head portion (e.g., a front portion of the housing) removed. As illustrated, a plurality of magnets 406 are disposed (e.g., within pockets or walled regions formed in the interior of the back connector head portion) alongside the plurality of electrical contacts 316.

Figure 7:
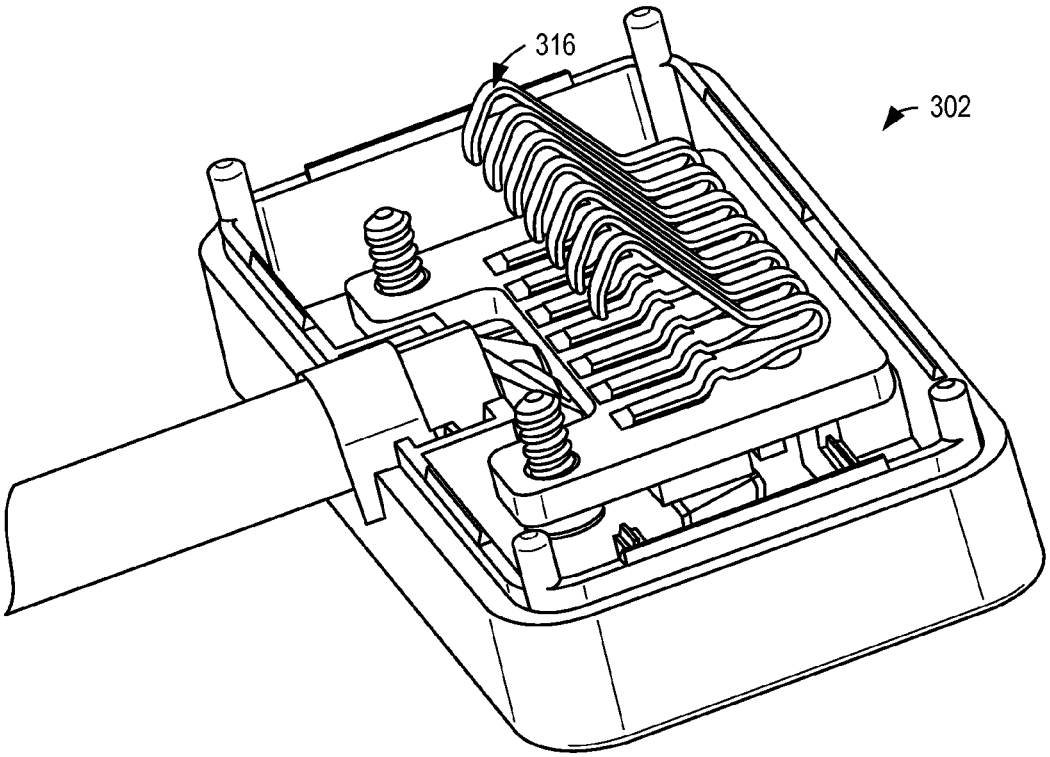
FIG. 7 shows a detail view of example electrical connectors of an example power and data connector.

FIG. 7 shows a detailed view of the electrical contacts 316, as viewable when the magnets 406 and other elements interfering with a view of the electrical contacts are removed from the interior of the connector head 302 and/or connector housing. As shown, each electrical contact 316 comprises a substantially rectangular strip of electrically conductive material (e.g., gold or any other suitable metal or metal alloy) mounted at one end to a substrate. The material forming the electrical contacts may be deformed to create a spring-loaded contact. For example, the rectangular strip forming the electrical contacts may be deformed, thereby producing a triangular peak that is biased to protrude from the stage (and the front portion of the connector head 302) and is moveable toward the stage 314 (and the back portion of the connector head 302) responsive to a force applied to the triangular peak. Accordingly, the triangular peak may be positioned at an end of the rectangular strip that is opposite from the end that is connected to the substrate 504.

In order to promote flexibility in a direction toward the back portion of the connector head 302, the electrical contacts 316 may include a plurality of bended regions. For example, the electrical contact may extend, at a location of contact, away from a power and data cable 304 in a planar manner along a first plane that is coplanar with the substrate 504. The electrical contact may then bend upward approximately 30-60 degrees (e.g. 45 degrees) from the first plane and then continue along a second plane that is parallel to and above the first plane. The electrical contact may then bend approximately 180 degrees to extend toward the power and data cable 304 along a third plane that is parallel to and above the second plane. Leading to the triangular peak, the electrical contact may extend at an angle of approximately 30-60 degrees (e.g., 55 degrees) from the third plane and terminate in the above-described triangular peak.

The spring-loaded electrical contacts 316 illustrated in FIGS. 6 and 7 may have a small width relative to other types of electrical contacts, enabling the illustrated number of contacts to produce a mirror-symmetric pin-out in a relatively small space. However, it is to be understood that any suitable electrical contact or combination of electrical contacts may be utilized without departing from the scope of this disclosure.

The above-described power and data connector may provide a mechanical or tactile feedback via a raised center stage and alignment properties of a magnetically attractive surface surrounding the raised center stage. In this way, the magnetic feature advantageously provides the aligning and coupling force to maintain the connection between the connector and the device, and the raised center stage advantageously provides the tactile feedback to the user as the connector snaps into place. The inclusions of the magnetic and mechanical features in combination leverage the advantages of both in a complementary manner.

Figure 8A:
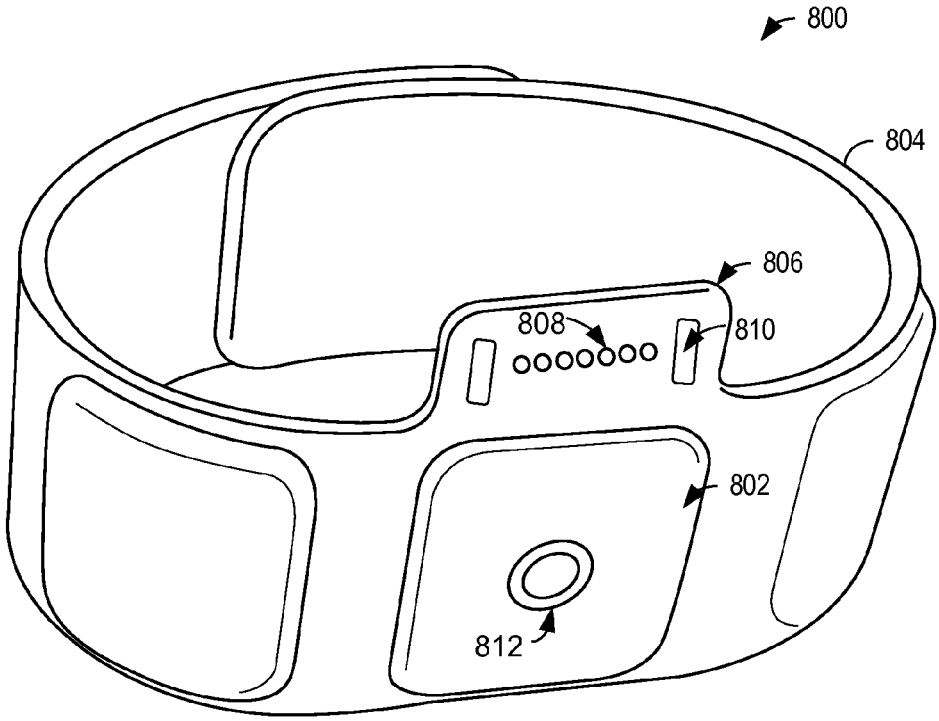
FIGS. 8A and 8B show different views of an exemplary wearable charging device.
Figure 8B:
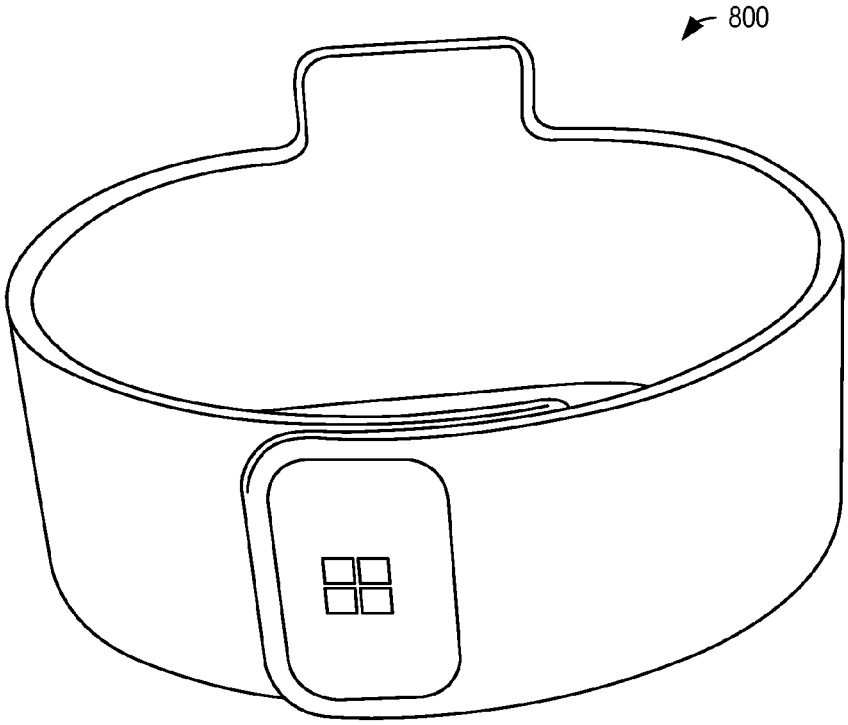

Additional or alternative power and data connectors may be utilized to recharge a wearable electronic device. FIGS. 8A and 8B show different views of an exemplary wearable charging device 800. For example, wearable charging device 800 may take the form of an adjustable wrist band as illustrated. As shown in FIG. 8A, wearable charging device 800 may include one or more batteries 802 disposed in, on, under, and/or around a wrist band 804. Wrist band 804 may additionally or alternatively incorporate solar panels to generate power from light. Wrist band 804 may be composed of any suitable flexible, rigid, and/or composite material including but not limited to cloth, silicone, rubber, metal, etc. In some examples, wrist band 804 may include a substrate disposed between layers of a cover material and/or within a cover material. In such examples, batteries 802 may be disposed between the substrate and the cover material and/or within the substrate. Wrist band 804 may include one or more fastening mechanisms, including but not limited to magnetic and/or mechanical (e.g., button, snap, clasp, etc.) fasteners. Wrist band 804 may additionally or alternatively utilize a hinged or flexible cuff configuration to adjustably conform to a wrist. As shown in FIG. 8B, a It is to be understood that the shape, material, and configuration of wrist band 804 may take any suitable form, include those described above with respect to wearable electronic device 10 of FIGS. 1A and 1B.

As shown in FIG. 8A, wrist band 804 may include a protruding charging surface 806 adapted to engage with a power and data port, such as USB port 30 of FIGS. 1A, 1B, and 2. For example, wrist band 804 may be configured to be worn alongside a wearable device, such as wearable electronic device 10 of FIGS. 1A and 1B. Charging surface 806 may thereby be inserted between the wearable device and the user's wrist to contact a power and data port of the wearable device. In other words, an upper and/or outer surface of charging surface 806 may be configured to be in face-sharing contact with an outer surface of a power and data port (e.g., an underside of a display of a wearable electronic device). Charging surface 806 may include a plurality of charging pins 808 configured to electrically connect to respective charging pads on a power and data port, such as charging contact pads 206 of FIG. 2. Charging pins 808 may be spring-loaded and/or take any suitable form as described above with respect to electrical contacts 316 of FIG. 3. For example, charging pins 808 may have a POGO pin configuration in some examples. Charging surface 806 may include one or more magnets 810 (e.g., disposed under a surface material in a similar manner to batteries 802) in order to assist with alignment and attachment to the power and data port. For example, magnets 810 may be positioned at locations relative to charging pins 808 selected to ensure contact to metal frame 202 of USB port 30 illustrated in FIG. 2.

Wrist band 804 may include an indicator 812 configured to output a visual indication of a charging state, battery consumption level, and/or other status of the charging device (e.g., wearable charging device 800) and/or device being charged (e.g., wearable electronic device 10). For example, indicator 812 may be configured to output different colors, patterns, and/or sequences of light to provide feedback regarding the different statuses. In some examples, audible and/or tactile feedback may be provided via associated feedback devices (e.g., speakers, motors, etc.). One or more locations on wrist band 804 may be touch-sensitive, enabling a user to provide input to the charging device and/or the device being charged (e.g., via control signals transmitted through charging pins 808). Wrist band 804 may include a wireless transceiver to enable a connected device to communicate with other devices, servers, and cloud-based devices using telecommunication protocols such as 3G, 4G, and LTE cellular protocols, and 802.11 Wi-Fi protocols.

Wearable charging device 800 may enable a wearable electronic device to be recharged during operation. By cooperating with an overall shape of the wearable electronic device, the charging device may provide a comfortable and convenient battery boost during heavy and/or long use of the wearable electronic device.

As evident from the foregoing description, the methods and processes described herein may be tied to a sensory-and-logic system of one or more machines. Such methods and processes may be implemented as a computer-application program or service, an application-programming interface (API), a library, firmware, and/or other computer-program product. FIGS. 1A and 1B show one, non-limiting example of a sensory-and-logic system to enact the methods and processes described herein. However, these methods and process may also be enacted on sensory-and-logic systems of other configurations and form factors, as shown schematically in FIG. 9.

Figure 9:
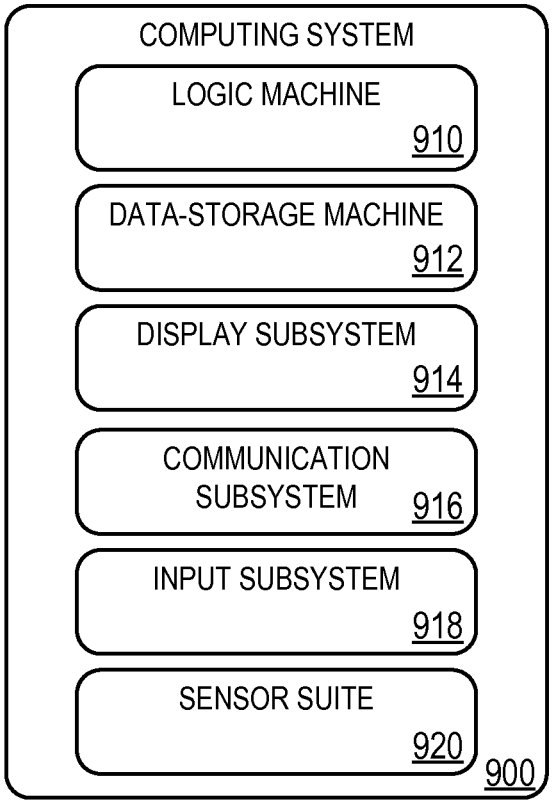
FIG. 9 schematically shows an example computing device.

FIG. 9 schematically shows a form-agnostic sensory-and-logic system 910 that includes a sensor suite 912 operatively coupled to a compute system 914. The compute system includes a logic machine 916 and a data-storage machine 918. The compute system is operatively coupled to a display subsystem 920, a communication subsystem 922, an input subsystem 924, and/or other components not shown in FIG. 9.

Logic machine 916 includes one or more physical devices configured to execute instructions. The logic machine may be configured to execute instructions that are part of one or more applications, services, programs, routines, libraries, objects, components, data structures, or other logical constructs. Such instructions may be implemented to perform a task, implement a data type, transform the state of one or more components, achieve a technical effect, or otherwise arrive at a desired result.

Logic machine 916 may include one or more processors configured to execute software instructions. Additionally or alternatively, the logic machine may include one or more hardware or firmware logic machines configured to execute hardware or firmware instructions. Processors of the logic machine may be single-core or multi-core, and the instructions executed thereon may be configured for sequential, parallel, and/or distributed processing. Individual components of a logic machine optionally may be distributed among two or more separate devices, which may be remotely located and/or configured for coordinated processing. Aspects of a logic machine may be virtualized and executed by remotely accessible, networked computing devices in a cloud-computing configuration.

Data-storage machine 918 includes one or more physical devices configured to hold instructions executable by logic machine 916 to implement the methods and processes described herein. When such methods and processes are implemented, the state of the data-storage machine may be transformed—e.g., to hold different data. The data-storage machine may include removable and/or built-in devices; it may include optical memory (e.g., CD, DVD, HD-DVD, Blu-Ray Disc, etc.), semiconductor memory (e.g., RAM, EPROM, EEPROM, etc.), and/or magnetic memory (e.g., hard-disk drive, floppy-disk drive, tape drive, MRAM, etc.), among others. The data-storage machine may include volatile, nonvolatile, dynamic, static, read/write, read-only, random-access, sequential-access, location-addressable, file-addressable, and/or content-addressable devices.

It will be appreciated that data-storage machine 918 includes one or more physical devices. However, aspects of the instructions described herein alternatively may be propagated by a communication medium (e.g., an electromagnetic signal, an optical signal, etc.) that is not held by a physical device for a finite duration.

Aspects of logic machine 916 and data-storage machine 918 may be integrated together into one or more hardware-logic components. Such hardware-logic components may include field-programmable gate arrays (FPGAs), program- and application-specific integrated circuits (PASIC/ASICs), program- and application-specific standard products (PSSP/ASSPs), system-on-a-chip (SOC), and complex programmable logic devices (CPLDs), for example.

Display subsystem 920 may be used to present a visual representation of data held by data-storage machine 918. This visual representation may take the form of a graphical user interface (GUI). As the herein described methods and processes change the data held by the storage machine, and thus transform the state of the storage machine, the state of display subsystem 920 may likewise be transformed to visually represent changes in the underlying data. Display subsystem 920 may include one or more display subsystem devices utilizing virtually any type of technology. Such display subsystem devices may be combined with logic machine 916 and/or data-storage machine 918 in a shared enclosure, or such display subsystem devices may be peripheral display subsystem devices. Display 20 of FIGS. 1A and 1B is an example of display subsystem 920.

Communication subsystem 922 may be configured to communicatively couple compute system 914 to one or more other computing devices. The communication subsystem may include wired and/or wireless communication devices compatible with one or more different communication protocols. As non-limiting examples, the communication subsystem may be configured for communication via a wireless telephone network, a local- or wide-area network, and/or the Internet. Communication suite 24 of FIGS. 1A and 1B is an example of communication subsystem 922.

Input subsystem 924 may comprise or interface with one or more user-input devices such as a keyboard, mouse, touch screen, or game controller. In some examples, the input subsystem may comprise or interface with selected natural user input (NUI) componentry. Such componentry may be integrated or peripheral, and the transduction and/or processing of input actions may be handled on- or off-board. Example NUI componentry may include a microphone for speech and/or voice recognition; an infrared, color, stereoscopic, and/or depth camera for machine vision and/or gesture recognition; a head tracker, eye tracker, accelerometer, and/or gyroscope for motion detection and/or intent recognition; as well as electric-field sensing componentry for assessing brain activity. Touch screen sensor 32 and push buttons 34 of FIGS. 1A and 1B are examples of input subsystem 924.

Sensor suite 912 may include one or more different sensors—e.g., a touch-screen sensor, push-button sensor, microphone, visible-light sensor, ultraviolet sensor, ambient-temperature sensor, contact sensors, optical pulse-rate sensor, accelerometer, gyroscope, magnetometer, and/or GPS receiver—as described above with reference to FIGS. 1A and 1B.

It will be understood that the configurations and approaches described herein are exemplary in nature, and that these specific implementations or examples are not to be taken in a limiting sense, because numerous variations are feasible. The specific routines or methods described herein may represent one or more processing strategies. As such, various acts shown or described may be performed in the sequence shown or described, in other sequences, in parallel, or omitted.

The subject matter of this disclosure includes all novel and non-obvious combinations and sub-combinations of the various processes, systems and configurations, and other features, functions, acts, and/or properties disclosed herein, as well as any and all equivalents thereof.

The invention claimed is:

1. A power and data connector having a front side, the power and data connector comprising:

a magnet having a front surface at the front side of the power and data connector;

a body housing the magnet and opening to the front surface of the magnet;

a film adhered to the front surface of the magnet;

a stage at the front side extending out and away from the magnet and the film; and a plurality of electrical contacts disposed on the stage in alignment with a longitudinal axis bisecting a widest dimension of the stage, the plurality of electrical contacts symmetrically spaced relative to a vertical axis perpendicular to the longitudinal axis for a mirrored signal pin-out.

2. The power and data connector of claim 1, wherein the plurality of electrical contacts includes a power contact, two ground contacts, and two or more signal contacts.

3. The power and data connector of claim 1, wherein the vertical axis passes through a central electrical contact.

4. The power and data connector of claim 3, further comprising a power and data cable extending from a housing surface of the power and data connector in a perpendicular direction to the longitudinal axis, the power and data cable terminating in a universal serial bus (USB) connector at an end opposite of the housing surface, and the housing surface being adjacent and perpendicular to a surface comprising the stage.

5. The power and data connector of claim 3, wherein the film is curved concavely along a vertical dimension extending perpendicularly to the longitudinal axis and is planar along a horizontal dimension extending in parallel to the longitudinal axis.

6. The power and data connector of claim 5, wherein the stage is planar in the vertical dimension and the horizontal dimension.

7. The power and data connector of claim 3, wherein the plurality of electrical contacts comprises a first pair of contacts tied together and electrically connected to a single data signal source, a second pair of contacts tied together and electrically connected to a single negative data signal source, a third pair of contacts tied together and electrically connected to ground, and a single contact electrically connected to a voltage source.

8. The power and data connector of claim 1, wherein the film comprises a flexible Mylar adhesive.

9. The power and data connector of claim 1, wherein each of the plurality of electrical contacts comprises a rectangular strip of electrically conductive material that is deformed to produce a spring-loaded pin.

10. The power and data connector of claim 9, wherein a portion of the rectangular strip of electrically conductive material is deformed producing a triangular peak that is biased to protrude from the stage and is moveable toward the stage responsive to a force applied to the triangular peak.

11. The power and data connector of claim 10, wherein the stage comprises a plurality of openings, each opening corresponding to a different electrical contact of the plurality of electrical contacts, and wherein the triangular peak of each electrical contact of the plurality of electrical contacts is biased to protrude through a respective opening in the stage.

12. The power and data connector of claim 1, wherein the plurality of electrical contacts are configured to transmit data and/or provide power to a wearable device, the power and data connector being adapted to interface with a universal serial bus (USB) port located on the wearable device.

13. The power and data connector of claim 1, wherein the film is rectangular with rounded corners.

14. A male electronic connector having a front side, the male electronic connector comprising:

a body defining an opening on the front side of the male electronic connector;

one or more magnetically attractable elements housed within the body, each magnetically attractable element having a front surface exposed via the opening on the front side of the male electronic connector;

a film adhered to the front surface of each of the one or more magnetically attractable elements;

a stage at the front side extending out and away from the one or more magnetically attractable elements and the film, the film surrounding the stage, and a geometric area of the film being at least 2.5 times larger than a geometric area of the stage; and a plurality of electrical contacts disposed on the stage, the plurality of electrical contacts having a mirrored signal pin-out.

15. The male electronic connector of claim 14, wherein the stage is centered relative to a longitudinal axis bisecting a widest dimension of the male electronic connector and a vertical axis perpendicular to the longitudinal axis.

16. The male electronic connector of claim 14, wherein the one or more magnetically attractable elements include a permanent magnet, an electromagnet, or a material element that is attractable by a magnet.

17. The male electronic connector of claim 14, wherein the body includes one or more openings and wherein each of the one or more magnetically attractable elements are aligned with a respective opening in the body.

18. A power and data connector having a front side, the power and data connector comprising:

a magnet having a front surface at the front side of the power and data connector, the magnet housed within a body of the power and data connector;

a film contacting the front surface of the magnet;

a stage at the front side extending out and away from the magnet and the film; and a plurality of electrical contacts disposed on the stage symmetrically along a longitudinal axis bisecting a widest dimension of the power and data connector, the plurality of electrical contacts having a mirrored signal pin-out, and a front surface of the power and data connector being curved concavely along a vertical dimension extending perpendicularly to the longitudinal axis and planar along a horizontal dimension extending in parallel to the longitudinal axis.

19. The power and data connector of claim 18, wherein the body of the power and data connector includes an overlapping edge that is in a parallel plane to the front surface of the magnet and extends around a periphery of the front surface of the magnet.

20. The power and data connector of claim 18, wherein the stage is planar along the vertical dimension and the horizontal dimension, and wherein walls of the stage angle outward in a direction extending from an outward surface of the stage and the film such that a base of the stage is larger than the outward surface of the stage.

* * * * *